United States Patent [19]

Palmer

[11] Patent Number: 4,544,092

[45] Date of Patent: Oct. 1, 1985

[54] CROSS PARTITION INTERLOCK USING ENLARGED TAB

[75] Inventor: Willard Palmer, Bartlett, Ill.

[73] Assignee: Rock-Tenn Company, Norcross, Ga.

[21] Appl. No.: 649,201

[22] Filed: Sep. 10, 1984

[51] Int. Cl.[4] ..... B65D 5/48

[52] U.S. Cl. ..... 229/15; 217/31; 229/42

[58] Field of Search ..... 229/15, 42; 217/30–33

[56] References Cited

U.S. PATENT DOCUMENTS

| | | | |
|---|---|---|---|
| 324,999 | 8/1885 | Jaeger | 217/32 |
| 456,353 | 7/1891 | Bower | 217/32 |
| 529,173 | 11/1894 | Herr | 217/32 |
| 533,331 | 1/1895 | Williams | 217/32 |
| 606,913 | 7/1898 | Bower | 217/32 |
| 658,930 | 10/1900 | Starman | 217/32 |
| 786,827 | 4/1905 | Meyer | 217/32 |
| 969,087 | 8/1910 | Carter . | |
| 1,006,716 | 10/1911 | Bloomer | 217/32 |
| 1,143,036 | 6/1915 | Carter . | |
| 1,174,844 | 3/1916 | Fukumura . | |
| 1,313,948 | 8/1919 | Maegly | 217/32 |
| 1,428,594 | 9/1922 | Kainer . | |
| 1,528,341 | 3/1925 | Navarro | 217/31 |
| 1,675,278 | 6/1928 | Segur . | |
| 1,755,208 | 4/1930 | Coyle | 217/32 |
| 1,768,023 | 6/1930 | Benoit . | |
| 1,805,870 | 5/1931 | Inman | 217/32 |
| 1,894,402 | 1/1933 | Inman | 217/33 |
| 1,919,458 | 7/1933 | Benoit | 217/32 |
| 1,975,106 | 10/1934 | Klefeker | 229/29 R |
| 2,175,670 | 10/1939 | Rutledge | 217/32 |
| 2,673,656 | 3/1954 | Cunningham | 217/32 |
| 2,920,782 | 1/1960 | Butters | 217/32 |
| 4,000,845 | 1/1977 | Zeller | 229/15 |
| 4,103,818 | 8/1978 | Raubenheimer | 229/15 |
| 4,194,675 | 3/1980 | Peters | 229/15 |
| 4,358,047 | 11/1982 | Raubenheimer | 229/15 |

FOREIGN PATENT DOCUMENTS

| | | |
|---|---|---|
| 1377/26 | 4/1926 | Australia . |

*Primary Examiner*—William Price
*Assistant Examiner*—Gary E. Elkins
*Attorney, Agent, or Firm*—Rogers, Howell, Renner, Moore & Haferkamp

[57] ABSTRACT

An interlock for a partition assembly made of paper board or the like and having interlocking longitudinal and cross partition strips that form a divider for insertion in a box for shipping items such as bottles, cans, and the like. The interlock includes a slot in each of the longitudinal and cross strips, the slots interfitting to lock the strips together but allowing them to hinge freely between collapsed and open configurations.

12 Claims, 10 Drawing Figures

CROSS PARTITION INTERLOCK USING ENLARGED TAB

BACKGROUND AND SUMMARY OF THE INVENTION

This invention relates to an interlock for a partition assembly used to divide boxes and the like into a plurality of cells for containing and protecting various types of goods such as bottles, cans, and other containers.

Partition assemblies of this general type are well known in the art and generally include a set of longitudinal partition strips and a set of cross partition strips. Typically, the strips are of paperboard material and have interlocking slots such that the slots of the cross strips interlock with the slots of the longitudinal strips to provide a partition assembly. The interlocking slots are such that the partition assembly may be hinged between a fully opened configuration with the cross strips perpendicular to the longitudinal strips, and closed configurations with the partition assembly collapsed and the longitudinal and cross strips overlying one another. In other words, one set of strips may be hinged relative to the other set approximately 180° so that the assembly may be collapsed in either of two collapsed positions.

In known partition assemblies, the interlocking strips may include corresponding tabs and tab receiving openings such that the tabs of one set of strips are received in and are retained within tab receiving openings of the other set of strips, thus "interlocking" the sets of strips together. One type of known assembly has such tabs near the edges of the strips and where the corresponding tab receiving openings are also at the edges. These are exemplified by Zeller U.S. Pat. No. 4,000,845. Other assemblies have the tabs and the tab receiving openings of the interlocking slots inwardly of the edges of the strips and may be characterized as "center lock" partitions as exemplified by U.S. Pat. Nos.: Bower 456,353, Herr 529,173, Williams 533,331, Carter 1,143,036, Navarro 1,528,341, Inman 1,894,402, and Raubenheimer 4,103,818 and 4,358,047.

Typically, partitions of the general type to which this invention relates are assembled and shipped to the customer in a collapsed configuration in a bundle. The customer may then use automatic equipment to extract the partition from the bundle, expand it, insert in into a box, and then load the box for shipment of goods. This means that the partition must hinge freely between collapsed and fully open configurations, the interlocks must not bind or distort or become disengaged during these operations, and yet the interlock design should provide for ease in assembly of the cross strips with the longitudinal strips into proper interfitting relation with automated assembly equipment. Thus, the problem is that an interlock design that holds the partition firmly together may not allow the longitudinal and cross strips to hinge freely or may be difficult to assemble, while one that is easy to assemble may have problems with holding together during the various operations.

The present invention provides an interlock for a partition assembly of a center lock type which may be readily assembled, which hinges freely between collapsed and opened configurations, and which is exceptional in retaining the interfitting strips in proper interlocking engagement during the various operations to which the assembly is subjected. In accordance with the invention, generally the interlock includes a slot in each interlocking strip, the longitudinal and cross strip. These slots open at the edges of the strips and extend inwardly to terminate within the strips. Each slot also includes a tab extending from a side edge of the slot and at least one of the slots has a tab retaining edge which engages the tab of the other slot. The tab of one of the slots has a base portion adjacent the edge of the slot from which it extends and a portion laterally of the base portion which protrudes into the slot. A portion of the tab laterally of the base portion extends longitudinally (in the direction of the slot or along the hinge axis) beyond the base portion, and preferably is generally of a butterfly design having wings of an overall length greater than the base. The butterfly tab overlaps at least a portion of the strip with which it interlocks in both of the two collapsed configurations, and also aids in holding the partition assembly in the proper interlocked condition with the assembly open. The improved interlock design of the present invention allows ease in assembly and hinges freely between collapsed and open configurations.

These and other objects and advantages of the invention are apparent from the drawing and detailed description to follow.

DESCRIPTION OF THE DRAWINGS

FIG. 2 is a perspective view of the partition assembly of FIG. 1 shown folded in one direction to a partially opened configuration;

DETAILED DESCRIPTION OF THE PREFERRED EMBODIMENT

Figure 1:
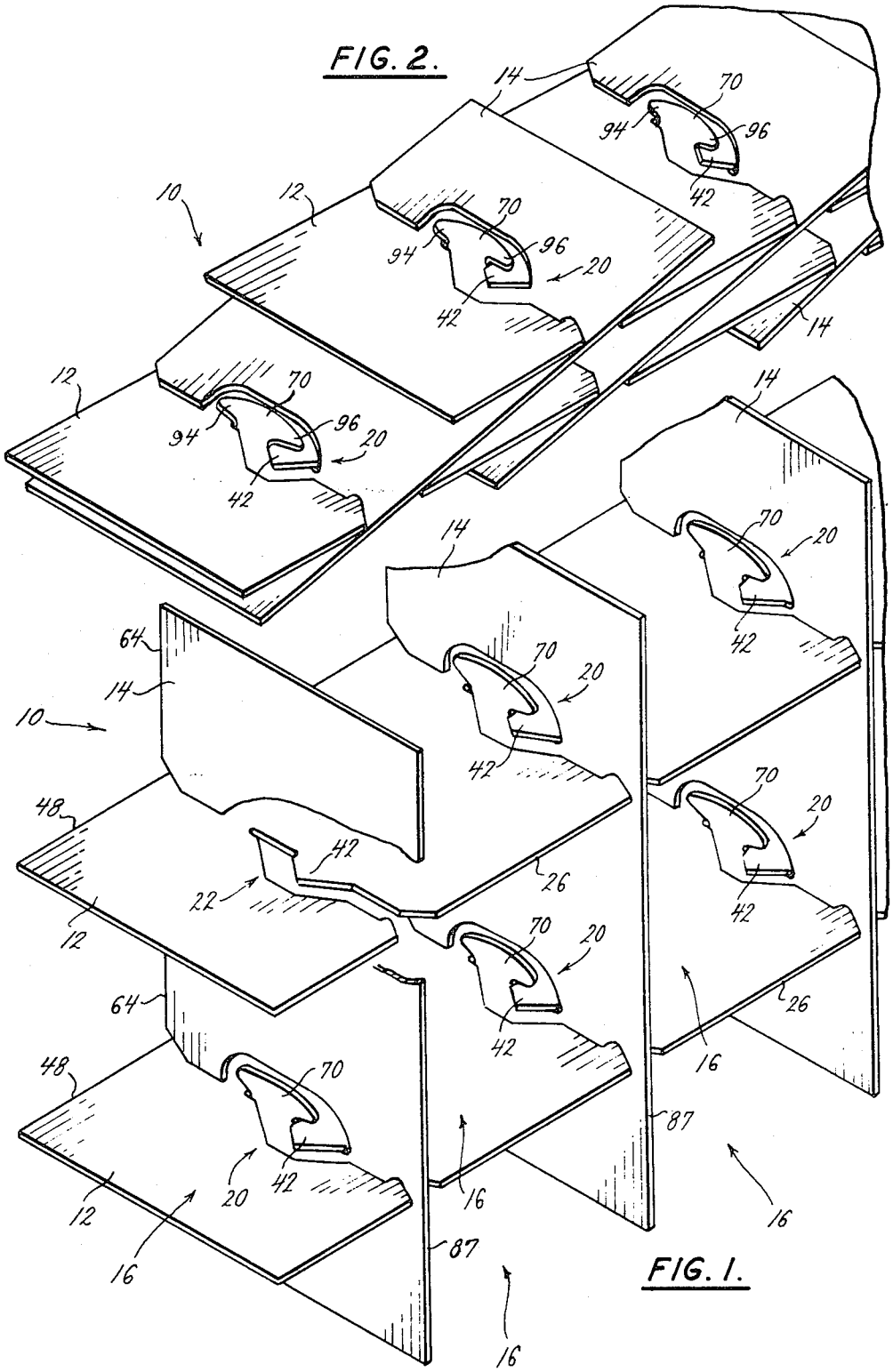
FIG. 1 is a perspective view of a partition assembly with an interlock of the present invention shown in the fully opened configuration.
Figure 6:
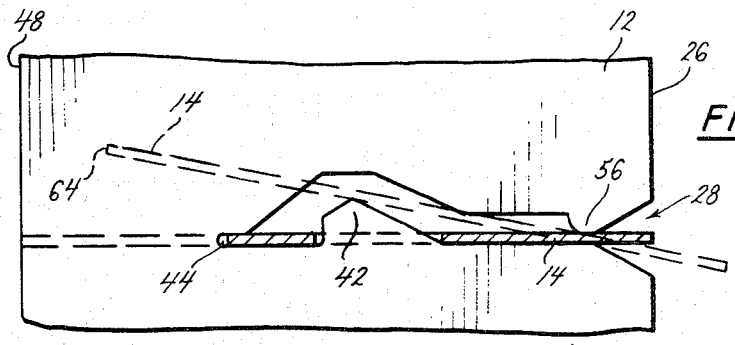
FIG. 6 is a plan view of a slot of a longitudinal strip and illustrating a cross strip being brought into interlocking engagement therewith.
Figure 5:
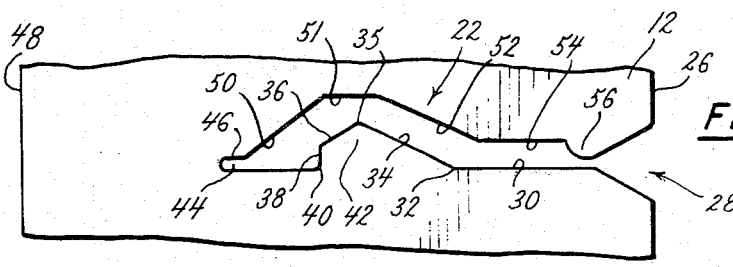
FIG. 5 is a plan view showing a slot of a longitudinal strip.
Figure 4:
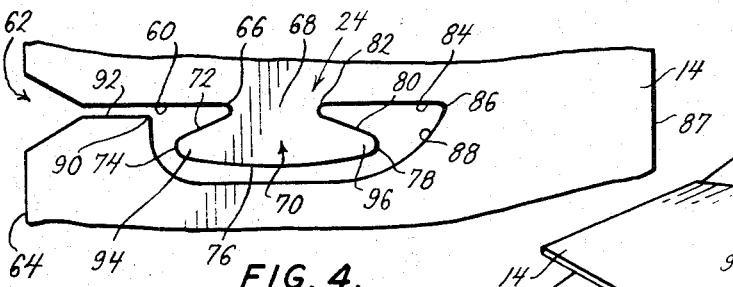
FIG. 4 is a plan view showing a slot of a cross strip.

With reference to the drawing, there is shown a partition assembly 10 having longitudinal partition strips 12 and cross partition strips 14. Such strips are typically of a paperboard material with each set of strips (the longitudinal set and the cross strip set) being parallel. With the assembly in the fully opened configuration as shown in FIG. 1, the strips define rectangular cells 16 having side walls formed of the partition strips. The assembly is for insertion into a box for loading the the cells with containers such as bottles, cans, or the like for shipment.

Figure 3:
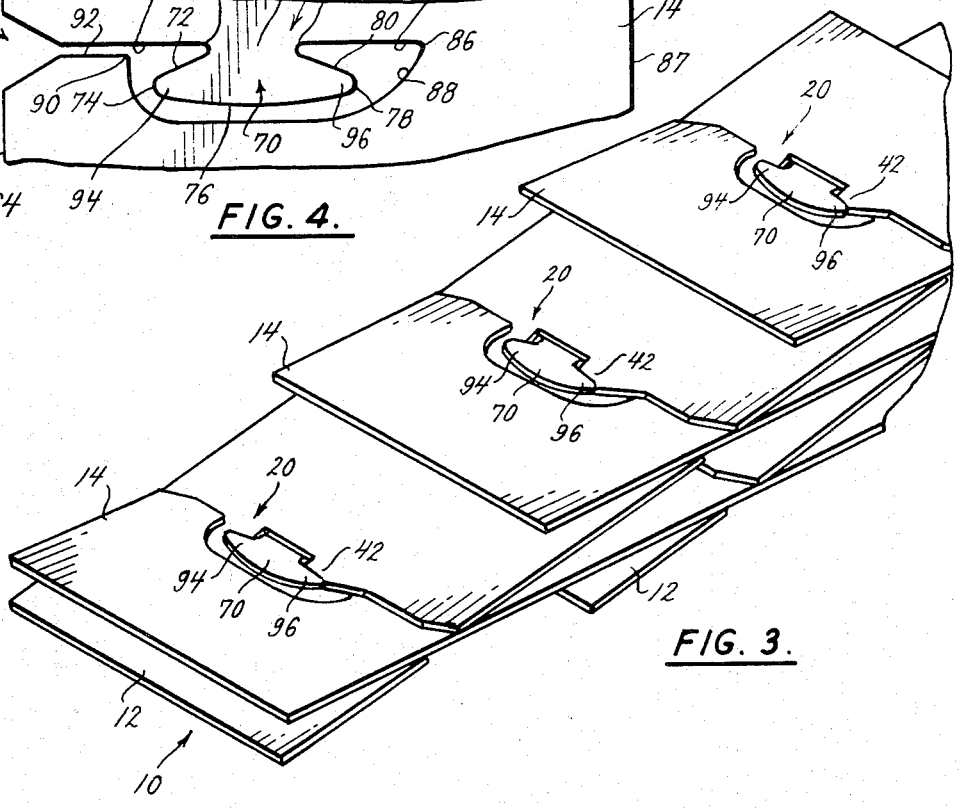
FIG. 3 is a perspective view of the partition assembly of FIG. 1 shown folded in the other direction to a partially opened configuration.

At each junction between a longitudinal and cross strip is an interlock 20 of the present invention for holding the sets of strips in engagement while allowing one set of strips to hinge freely relative to the other between collapsed configurations as shown in FIGS. 2 and 3, and the fully opened configuration as shown in FIG. 1. Thus, each interlock 20 may be thought of as having a hinge axis about which the interlocking strips hinge at that interlock joint. Each interlock 20 includes a slot design 22 in the longitudinal strip and a slot design 24 in the cross strip. One or more of such slots may be in the strips depending on the number of cells required. The slots 22 and 24 interfit to engage the cross strips with the longitudinal strips.

The configurations of the slots 22 and 24 differ. The slot 22 opens at an edge 26 of the strip 12 with a flaired opening 28. One side edge 30 of the slot extends normal to the strip edge 26 straight inwardly to a location 32 whereupon it slopes inwardly and laterally at a sloping edge 34 to a point 35, then further inwardly and laterally back along a sloping edge 36, and then laterally back along an edge 38 to a corner 40. The area of the partition bordered by the sloping edges 34 and 36 and edge 38 defines a tab 42 that protrudes generally laterally into the slot opening. The edge 38 is a tab retaining edge which retains the tab of the strip 14 against vertical displacement as will be described. The corner 40 is in vertical alignment with the edge 30. From the corner 40 an edge 43, aligned with the edge 30, extends inwardly to the terminal end of the slot where there is formed a small notch 44. The notch 44 has a lip 46 such that the cross strip 14 may seat within the notch. The notch defines another retaining edge which faces the retaining edge 38. The tab of the strip 14 is retained between these edges. As seen from the drawing, the slot 22 terminates within the strip 12 at a location spaced from the opposite strip edge 48. The edges 30 and 45 lie along a hinge axis about which the longitudinal and cross strips hinge between collapsed and open configurations.

From the lip 46 the opposite side of the slot 22 has an edge 50 sloping generally outwardly and laterally away from the edge 43 to an edge 51 which is opposite the tab 42 and parallel to the hinge axis. From the edge 51 there is an edge 52 which slopes outwardly and laterally back to an edge 54, which is parallel to the edge 30, and then to a tongue 56 at the flared opening of the slot. The width of the slot 22 is substantially greater than the thickness of the mating strip, except that the width of the notch 44 and the distance between the tongue and edge 30 are just slightly greater than the thickness of the mating strip. Hence, tongue 56 and the edge 30 along with the notch 44 help to hold the cross strip in alignment when interlocked therewith.

The mating slot 24 has a side edge 60 which extends straight inwardly from a flaired opening 62 at the strip edge 64. The side edge 60 extends to a corner 66 at the base 68 of a tab 70. The tab is defined by an edge 72 extending outwardly from the corner 66 at an acute angle with the edge 60 to a tip 74. From there the edge extends generally inwardly along a curved edge 76 to a tip 78 and from there along an edge 80 back to a corner 82 at the base 68. From the corner 82, an edge 84 extends straight inwardly to the terminal end 86 of the slot which is spaced from the opposite strip edge 87. The edge 84 is in alignment with the edge 60 along the hinge axis, and forms an acute angle with the edge 80.

The slot 24 has an opposite edge having a curved edge portion 88 extending from the terminal end 86, around the tab 70, and to a corner 90 above the tab, and a straight edge portion 92 extending outwardly therefrom to the flaired opening 62.

Thus, the tab 70 widens both inwardly and outwardly as it extends laterally from its base 68. The tab is symmetrical about a lateral axis and has wings 94 and 96 defining a "butterfly" shape whereby the dimension of the tab in the direction of the hinge line becomes greater laterally from its base.

The strips 12 and 14 are assembled by automatic equipment. One set of the strips is brought into parallel relationship with each vertical such that their slots open to the top. The other set of strips are then driven downwardly, their slots opening downwardly, into engagement with the one set, the slots 22 fitting within the slots 24 to interlock the strips together. As the strips move into engagement, the corner 66 at the base of the slot 24 engages the sloping edge 34 of the tab 42 causing the cross strip to skew as generally illustrated by the dashed line position in FIG. 7. The flexibility in the paperboard allows the base of the tab 70 to continue past the nose of the tab 42 until it engages the sloping edge 50 which guides the base of the tab 70 around the tab 42 and into engagement with the edge 43. The tab 42 extends into the opening between the corner 82 and end 86 of the slot 24 to engage the edge 84. The two strips then become interlocked as shown in FIG. 1.

Figure 7:
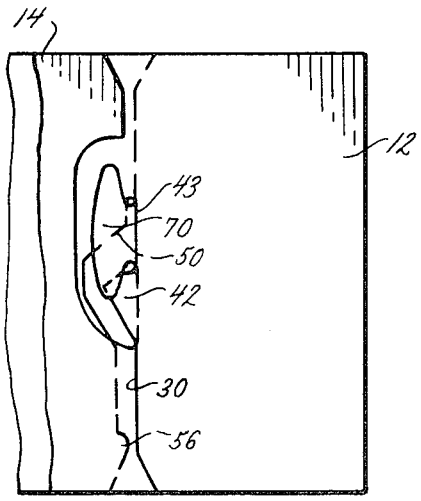
FIG. 7 is a partial plan view of the partition assembly of FIG. 1 folded in the direction of FIG. 3, and showing the side of the interlock as viewed in FIG. 3.
Figure 9:
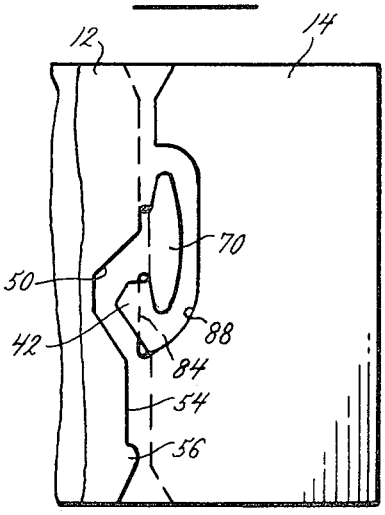
FIG. 9 is a partial plan view of the partition assembly of FIG. 1 folded in the direction of FIG. 2 and showing the side of the interlock as viewed in FIG. 2.
Figure 8:
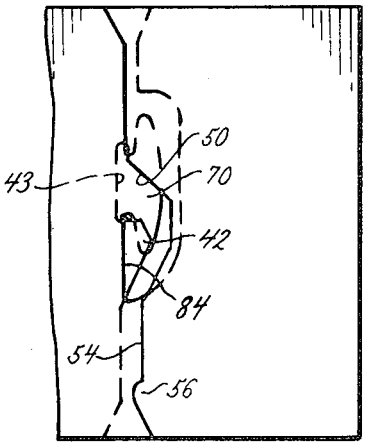
FIG. 8 is a partial view of the partition assembly of FIG. 1 folded in the direction of FIG. 3, and showing the side of the interlock opposite to that shown in FIG. 3.
Figure 10:
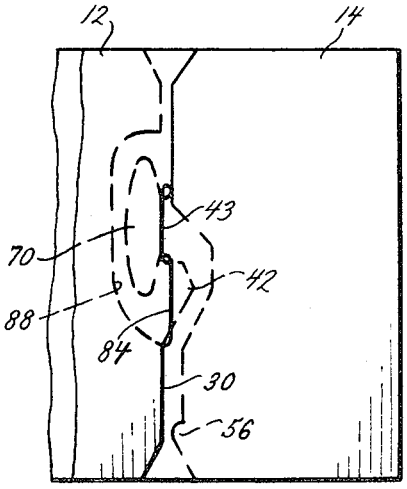
FIG. 10 is a partial plan view of the partition assembly of FIG. 1 folded in the direction of FIG. 2, and showing the side of the interlock opposite to that shown in FIG. 2.

It will be noted that the retaining edges 38 and 44 retain the base of the tab 70 therebetween by engagement with the corners 82 and 66 upon relative movement of the interlocked strips along the hinge line. Also, the wings of the tab 70, being wider than the edge 43 of the slot 22 help retain the interlocked strips in a parallelogram relationship. The tab 70 overlaps with a portion of the strip 12 in either of the two collapsed configurations to help hold the strips together regardless which way they are folded. FIGS. 2, 9, and 10 show the interlocks as viewed from both sides of the partition with it collapsed in one direction, and FIGS. 3, 7, and 8 show the interlocks as viewed from both sides of the partition with it collapsed in the opposite direction. It will be noted that in the collapsed position shown in FIGS. 3, 7, and 8, the butterfly portion 96 of the tab 70 overlaps with a portion of the tab 42, and the butterfly portion 94 overlaps with the portion of the strip 12 beneath the edge 50. With the partition collapsed to the position of FIGS. 2, 9 and 10, the tab 70, including both butterfly portions 94 and 96, overlaps with portions of the strip 12 adjacent the edge 43, and the tab 42 overlaps with a portion of the strip 14 adjacent the edge 84.

Hence, the present invention provides an interlock where the tab of each partition strip overlaps with a portion of the other strip in either of the two collapsed positions, and which provides an interlock which holds together in both the fully open and collapsed positions and yet hinges freely between collapsed and open positions.

There are various changes and modifications which may be made to applicant's invention as would be apparent to those skilled in the art. However, any of these changes of modifications are included in the teaching of applicant's disclosure and he intends that his invention be limited only by the scope of the claims appended hereto.

I claim:

1. In a partition assembly having interlocking longitudinal and cross partition strips, an interlock for interlocking a longitudinal partition strip with a cross partition strip such that the strips hinge along a hinge axis at the interlock between a fully open configuration with the longitudinal and cross strips perpendicular to each other and collapsed configurations with the strips generally overlying, said interlock comprising a first slot in one of said longitudinal and cross strips which opens at an edge thereof and extends inwardly and terminates within said strip, tab retaining edges adjacent the hinge axis, said tab retaining edges generally facing each other and spaced apart along said axis, said interlock further comprising a second slot in said other of said strips, said second slot interfitting with said first slot, and being open at an edge of said other strip and extending inwardly therefrom to terminate within said other strip, said second slot having a tab extending from a side edge of and into said slot, the tab having a base portion defined between corners at opposite ends thereof adapted to engage the tab retaining edges of said first slot to help lock the longitudinal and cross strips in interlocking engagement, said tab further having a portion that extends beyond at least one of said base corners in the direction of the hinge axis and overlies a portion of said one strip with the partition assembly in either collapsed configuration.

2. In the partition assembly of claim 1 wherein said tab has portions extending beyond both base corners which overlie a portion of said one strip in either collapsed configuration.

3. In the partition of claim 2 wherein said tab is wider at a location laterally of its base than the distance between the tab retaining edges of the first slot.

4. In the partition assembly of claim 3 wherein one of the tab retaining edges is at the terminal end of said first slot.

5. In the partition assembly of claim 1 wherein said tab base is adjacent the hinge axis.

6. In the partition assembly of claim 1 wherein said tab widens both inwardly and outwardly with respect to the slot as it extends laterally from its base into the slot, and wherein the widened portions have edges that slope away from said hinge axis as they extend from the base corners.

7. In the partition assembly of claim 1 wherein said one strip has a tab extending from a side edge of and into said first slot, one of said tab retaining edges being an edge of said tab and extending transversely from said slot side edge, the first slot tab fitting between the base of the second slot tab and the terminal end of the second slot with the strips interlocked.

8. In the partition assembly of claim 1 wherein with the partition in one collapsed configuration the tabs are substantially hidden when viewed from one side of the partition and exposed when viewed from the other, and wherein with the partition in its other collapsed configuration at least portions of both tabs are exposed when viewed from either side of the partition, and wherein in either collapsed configuration portions of each tab overlap with portions of the mating strip to help hold the strips in interlocking equipment.

9. In a partition strip of the kind described adapted to interengage with a corresponding partition strip to make a divider for cartons and the like; the partition strip having an edge, a slot having an entrance through said edge, one side of the slot having its edge extending inwardly to provide a hinging edge directed along a hinge axis, the slot terminating within the partition strip, a tab extending laterally within the slot from the hinge edge thereof, said tab having a base portion adjacent said hinge edge and a portion laterally of the base portion which extends beyond the base portion in a direction of the hinge axis.

10. In the partition strip of claim 9 wherein the width of said tab is greater at a location laterally of the base than at the base.

11. In the partition strip of claim 10 wherein the tab is generally of a butterfly shape having wing portions which extend beyond the base in the direction of the hinge axis.

12. In the partition strip of claim 11 wherein said tab is adapted to be received between tab retaining edges of a corresponding cross partition strip, and wherein the space between the base of the tab and the terminal end of the slot is adapted to receive a tab of a corresponding cross partition strip.

* * * * *